United States Patent [19]

Otterlei

[11] 4,145,584

[45] Mar. 20, 1979

[54] FLEXIBLE KEYBOARD SWITCH WITH INTEGRAL SPACER PROTRUSIONS

[76] Inventor: Jon L. Otterlei, 4704 Merilane, Edina, Minn. 55436

[21] Appl. No.: 790,759

[22] Filed: Apr. 25, 1977

Related U.S. Application Data

[63] Continuation-in-part of Ser. No. 681,069, Apr. 28, 1976, abandoned.

[51] Int. Cl.[2] ..... H01H 9/00; H01H 13/02

[52] U.S. Cl. ..... 200/5 A; 200/159 B; 200/292; 361/398

[58] Field of Search ..... 200/1 R, 5 R, 5 A, 16 A, 200/86 R, 159 R, 159 A, 159 B, 292, 83 L; 361/398; 174/68.5; 200/83 L

[56] References Cited

U.S. PATENT DOCUMENTS

| | | | |
|---|---|---|---|
| 2,909,628 | 10/1959 | Cooper | 200/86 R |
| 3,383,487 | 5/1968 | Wiener | 200/83 L X |
| 3,383,487 | 5/1968 | Wiener | 200/159 B X |
| 3,522,486 | 8/1970 | Johns et al. | 361/398 |
| 3,579,206 | 5/1971 | Grange | 174/68.5 X |
| 3,600,528 | 8/1971 | Leposavic | 200/5 A |
| 3,716,846 | 2/1973 | Volckart et al. | 174/68.5 X |
| 3,745,288 | 7/1973 | Reimer | 200/159 B X |
| 3,789,167 | 1/1974 | Seeger, Jr. et al. | 200/5 A |
| 3,819,989 | 6/1974 | Braune | 361/398 |
| 3,827,056 | 7/1974 | Vano | 361/398 X |
| 3,860,771 | 1/1975 | Lynn et al. | 200/5 A |
| 3,862,381 | 1/1975 | Glaister et al. | 200/5 A |
| 3,862,382 | 1/1975 | Glaister et al. | 200/5 A |
| 3,898,421 | 8/1975 | Suzumura | 200/159 B |
| 3,909,564 | 9/1975 | Scheingold et al. | 200/5 A X |
| 3,911,234 | 10/1975 | Kotaka | 200/5 A |
| 3,971,127 | 7/1976 | Giguere et al. | 175/68.5 X |
| 3,978,297 | 8/1976 | Lynn et al. | 200/86 R X |
| 4,028,509 | 6/1977 | Zurcher | 200/5 A |
| 4,046,975 | 9/1977 | Seeger, Jr. | 200/5 A |
| 4,066,851 | 1/1978 | White et al. | 200/5 A |

OTHER PUBLICATIONS

Lester, J. R., et al.; IBM Tech. Disc. Bull., "Switch", vol. 11, No. 11, 4-1969, p. 1569.

Harris, R. H.; IBM Tech. Disc. Bull., "Fold Switch", vol. 19, No. 10, Mar. 1977, pp. 3815, 3816.

*Primary Examiner*—James R. Scott

*Attorney, Agent, or Firm*—Merchant, Gould, Smith, Edell, Welter & Schmidt

[57] ABSTRACT

A keyboard switch construction in which contacting surfaces in spaced apposition on resilient, flexible, electrically non-conductive laminae are prevented from making contact in the absence of outside pressure by ribs formed in the material and substantially surrounding the conducting surface on one lamina. The switch construction is used in a control panel arrangement in which pilot and operative components are separately mounted and are associated by printed circuitry carried on a flexible insulating strip which may be physically continuous or may be electrically continuous using a multi-contact connector to interconnect two physically separate halves of the sheet.

15 Claims, 20 Drawing Figures

DEFROST
REST
COOK
PROBE TEMP
START
POWER LEVEL
DELAY START
CLEAR ENTRY
CLOCK
CANCEL

POWER LEVEL
START

FLEXIBLE KEYBOARD SWITCH WITH INTEGRAL SPACER PROTRUSIONS

CROSS REFERENCE TO RELATED APPLICATION

This application comprises a continuation-in-part of my copending application Ser. No. 681,069, filed Apr. 28, 1976, now abandoned.

BACKGROUND OF THE INVENTION

This invention relates to the general field of electrical engineering, and more particularly to a construction for keyboard switches whose contacts are areas of conductive material deposited on apposed surfaces of a resiliently flexible, electrically insulating material so that they may be brought into engagement by finger pressure on the material at predetermined locations.

Such structures are known, and it has been the custom to insert between laminae bearing apposed deposited conductive areas an insulating sheet having apertures positioned in alignment with the conductive areas, and of thickness sufficient to prevent engagement between them in the absence of applied force. Indeed it is known to use a single sheet of material folded along a line to bring conductive areas on the same surface of the material into apposition, relying on the inserted apertured insulating sheet to prevent unintended switch operation.

A very appropriate use for switching structures of this sort is found in the control panel for such an appliance as an automatic electric oven. Control panels of this sort are known, and have components which perform the actual functions controlling the distribution of power as desired, and components actuable by a user of the equipment to effect operation of the first named components. Herein I refer to these two sets of components as pilot components and keyboard components, respectively, the former comprising discrete circuit elements such as resistors, capacitors, transistors, integrated circuit modules, and indicator lights, and the latter comprising normally open, single-pole single-throw switches of special design, of which my copending application referred to above contained illustrative examples.

The advent of miniaturized components and solid state electronics has made it possible to construct a control panel of quite complex function for ready application as a unit to the outer surface of an appliance, for use in actuating its relays, timers, and other major controls, which I refer to as power components. It is desired that such control panels be compact, easily serviced, and trouble free over long periods of use, in addition to having the always advantageous features of ease of assembly, simplicity, and minimum number of individual elements and moving parts.

SUMMARY OF THE INVENTION

I have found that it is possible to dispense with the insertable insulation sheet, thus simplifying the construction and decreasing its cost. This I do by substantially surrounding the contact areas on one side of a fold line by ridges formed in the material, and I also apply the same principle to protect conductors from undesired contact, after folding, with other conductors or conductive areas. In my invention the conductive areas and the conductors leading thereto are deposited on a single surface of a sheet of Mylar, and substantially surrounded by ridges formed in the material by heat depression from the opposite surface, Then when the sheet is folded the ridges normally prevent unintended contact, but the material can yield under pressure to accomplish the desired conductive action.

Special patterns for conductive areas to replace single large areas have been devised to improve the reliability of the switching operation, and include both fields of individual parallel conductors, and fields occupied by interdigitating comb-like configurations, and arrangments are disclosed which enable the use of contacting areas free from conducting leads, where this is advantageous.

Also included in the invention here is an improved control panel construction in which particular advantage is taken of printed circuitry and circuit board techniques including my new keyboard switching arrangement. A printed circuit large enough to include both a pilot component portion and a keyboard component portion is etched, deposited, or otherwise formed on a flexible insulating sheet, which is folded into apposition with spaced parallel mounting and stiffening boards or sheets, and secured to one or both of them. The conductors between the two portions of the flexible printed circuit sheet may be brought close together and parallel where they extend across the fold, which may be strengthened by a second flexible sheet applied thereto over the conductors, and for special applications the sheet may be divided rather than folded and a multicontact electrical connector may be used to afford ready separation of the pilot and keyboard components during servicing. The improved ridge method of insulation outlined above may be used in connection with the keyboard components, or the older interlayer method may be resorted to. For some applications a single metal sheet or foil can advantageously be substituted instead of a number of mutually insulated conducting surfaces, and for those applications it may be possible to use a metallic stiffener board or sheet and avoid the need for a foil construction.

Various advantages and features of novelty which characterize my invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there are illustrated and described certain preferred embodiments of the invention.

DESCRIPTION OF THE PREFERRED EMBODIMENTS

Figures 1, 2, 3, 4, 5, 6:
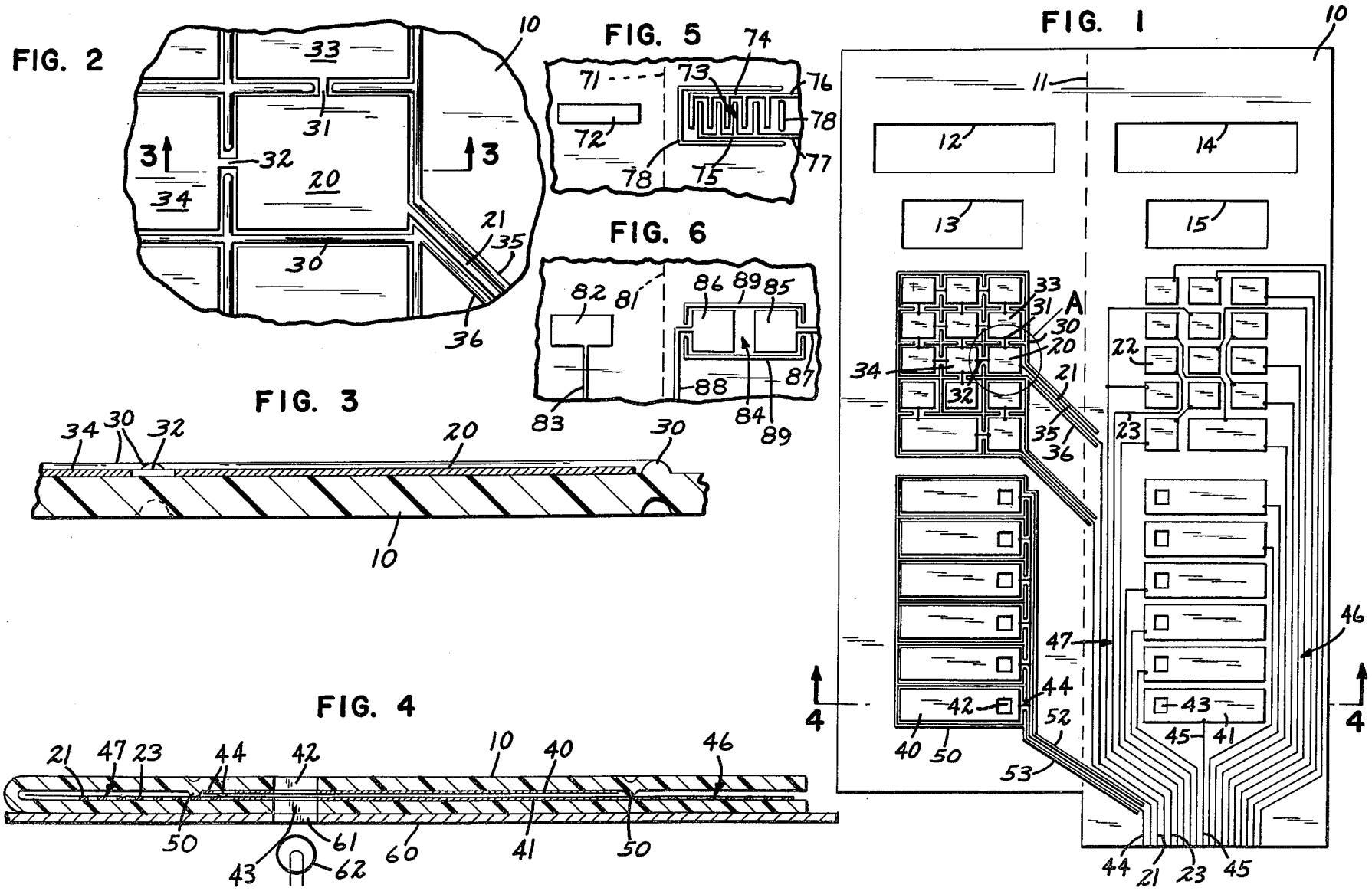
FIG. 1 is a plan view of a keyboard switch construction according to my invention.
FIG. 2 is an enlarged fragmentary view of the portion of FIG. 1 identified by the circle A.
FIG. 3 is a fragmentary sectional view along the line 3—3 of FIG. 2.
FIG. 4 is a sectional view, to a larger scale, taken along the line 4—4 of FIG. 1, but showing the material after folding.
FIGS. 5 and 6 are detailed showings of modified constructions according to the invention.

The drawing shows my invention as applied to a specific keyboard switch structure for the control panel of an automatic electric cooker. A sheet 10 of Mylar has a fold line 11 extending longitudinally therealong. Since indicator lamps and a digital readout are to be mounted behind the switch, apertures 12 and 13 are provided in the sheet, and further apertures 14 and 15 are provided in like positions on the opposite side of the fold line 11.

A number of conductive areas are provided on each side of fold line 11, but on the same surface of the Mylar. These areas are preferably produced by deposition of metal on the Mylar, and a bank of conductors is also provided leading to and, in some cases, interconnecting the conductive areas. Thus a conductive area 20 is deposited on the sheet 10, to the left of fold line 11, to which electrical connection is made by a conductor 21, and a conductive area 22 is deposited on the same surface of sheet 10, to the right of fold line 11, to which electrical connection is made by a conductor 23. It will be apparent that when the sheet is folded along line 11, contact areas 20 and 22 come into apposition, to act as the fixed contacts of a normally open, single-pole single-throw switch, and might even inadvertently make unintended contact.

To prevent this, conductive area 20 is substantially surrounded by a patterned ridge 30 raised in the Mylar by heat depression from the opposite side. Short breaks are provided in ridge 30 to pass conductor 21, and also conductors 31 and 32 leading to conductive areas 33 and 34 adjacent to area 20. The ridge is continued at 35, 36 along both sides of conductor 21, until it crosses to the other side of fold line 11. When the sheet is folded, ridge 30 prevents direct contact between areas 20 and 22, and also prevents direct contact between conductor 21 and other conductive areas with which conductor 21 is then in apposition. Under some conditions, only one of ridges 35 and 36 may be necessary.

FIG. 4 shows sheet 10 after folding, and is a section taken along the line 4—4 of FIG. 1. Reference numerals 40, 41 refer to conductive areas which are deposited on the Mylar to surround a pair of apertures or transparent areas 42, 43. Electrical connection is made to areas 40 and 41 by conductors 44 and 45, respectively. A bank 46 of conductors pass area 41 on the side remote from fold line 11, and a further bank 47 of conductors, including conductors 21 and 23, pass area 41 on the side next to the fold line. A ridge 50 surrounds area 40 except where conductor 44 passes to it. Ridges 52 and 53 lie on opposite sides of conductor 44 until it crosses the fold line.

The relation between these parts after the sheet is folded is clearly shown in FIG. 4, which also shows that the folded sheet is supported on a rigid plate 60 of suitable metal or plastic, where it is held by appropriate means, not shown, such as a suitable adhesive. Plate 60 is apertured at 61 in line with apertures 42 and 43, so that an indicator light 62 below plate 60 may be observed from above.

It is clear that ridge 50 prevents engagement between areas 40 and 41 and that ridges 52 and 53 prevent engagement between conductor 44 and conductors or conductive areas on the other side of the fold line. It has been found that for a Mylar sheet 0.004–0.010 inches in thickness, the ridges 30, 50 and so forth can be between 0.005 inches and 0.050 inches in height. Within these ranges, it is found that the flexibility and resilience of the Mylar is such that the ridges prevent contact between the conductive surfaces normally, and yet yield readily to finger pressure to produce the desired switching action.

FIG. 5 shows a modified construction embodying the invention in which it is not required that electrical conductors be provided in both portions of the Mylar sheet. The broken line 71 is representative of the fold line in a sheet of Mylar, or alternatively, of the edge between two such sheets. On one side of the line there is deposited a conductive area 72. On the other side of the line, in apposition with area 72, there is deposited a conductive pattern 73 made up of a pair of interfitting finger members 74 and 75 to which electrical connection is made along conductors 76 and 77, respectively. Pattern 73 is surrounded by a ridge 78, like ridges 30, 50 and so forth in FIG. 1, the ridge being interrupted to pass conductors 76 and 77. It will be evident that when area 72 is pressed into engagement with pattern 73, it bridges between members 74 and 75 at one or more locations to perform a switching function.

FIG. 6 shows a second modified construction embodying the invention. The broken line 81 is representative of the fold line in a sheet of Mylar, or alternatively, of the edge between two such sheets. On one side of the line there is deposited a conductive area 82 to which is connected a conductor 83. On the other side of the line, in apposition with area 82, is deposited a pattern 84 comprising a pair of conductive areas 85 and 86, to which are connected conductors 87 and 88, respectively. Pattern 84 is surrounded by a ridge 89 like ridges 78, 30, 50 and so forth, the ridge being interrupted to pass conductors 87 and 88. When area 82 is pressed into engagement with pattern 84, electrical connection is made from conductor 83 to both of conductors 87 and 88, thereby performing the switching function necessary to connect a pair of circuits in parallel to a single circuit.

It will be evident that ridges 78 and 89 could, with equal efficacy, be formed around areas 72 and 82, instead of around patterns 73 and 84, if such were desired.

The ridges 30, 50 and so forth may be formed in any appropriate embossing procedure. A hand tool may be used, but since the keyboard switches are mass production items, it is more efficient to press the printed Mylar sheet between male and female dies configured to form all the ridges at one impression. Appropriate heating of the tool or dies is of course contemplated.

It is also contemplated that decorative or instructional material may be visually printed on the surface of the Mylar which will be exposed when the switch is in use, or on a transparent overlay aligned therewith.

It will also be evident that the principle of maintaining conductive areas out of contact by the use of substantially surrounding ridges in the sheet is not limited to folded structures, but will apply equally to arrangements in which the two sets of conductive areas are on separate sheets of material held in alignment by any appropriate means such as a suitable adhesive.

Figures 7, 9, 10, 11:
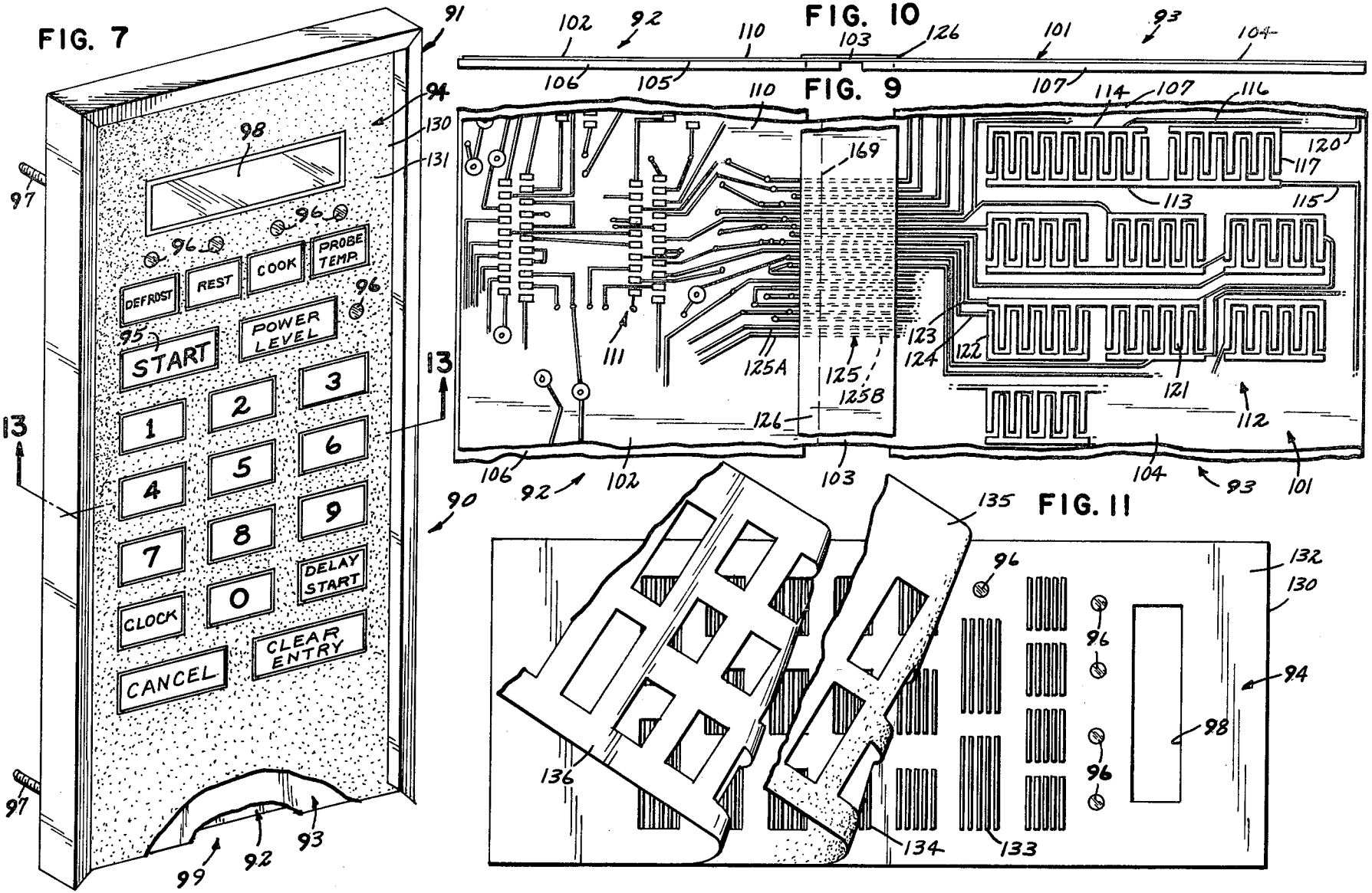
FIG. 7 is a schematic showing of a control panel construction embodying the invention.
FIG. 9 is a fragmentary showing generally like FIG. 8 but to a much larger scale.
FIG. 10 is a schematic end view of the structure of FIG. 9.
FIG. 11 shows a component of FIG. 7 as it can be supplied for commercial use.

A control panel 90 according to the invention is shown in FIG. 7 to comprise a rigid metal frame 91 containing keyboard components 93 and pilot components 92 as will be described below, and faced with a decorative cover 94, on which the sites for application of pressure to accomplish specified control functions are indicated by appropriate labels or indicia, of which START label 95 is representative. Cover 94 overlies the pilot and keyboard components, and may have clear or colored areas, as areas 96, which are transparent or translucent to make evident the illumination of indicator lights therebelow. Panel 90 is to be secured to its associated appliance by nuts screwed on to mounting studs 97 extending from the control panel through suitably located openings in the appliance. If desired a larger transparent area or opening 98 may be provided to make visible an operative or power component such as a clock or digital readout. One end 99 of frame 21 is left open, or may be provided with a removable closure if desired.

Figures 8, 12, 13, 14, 15:
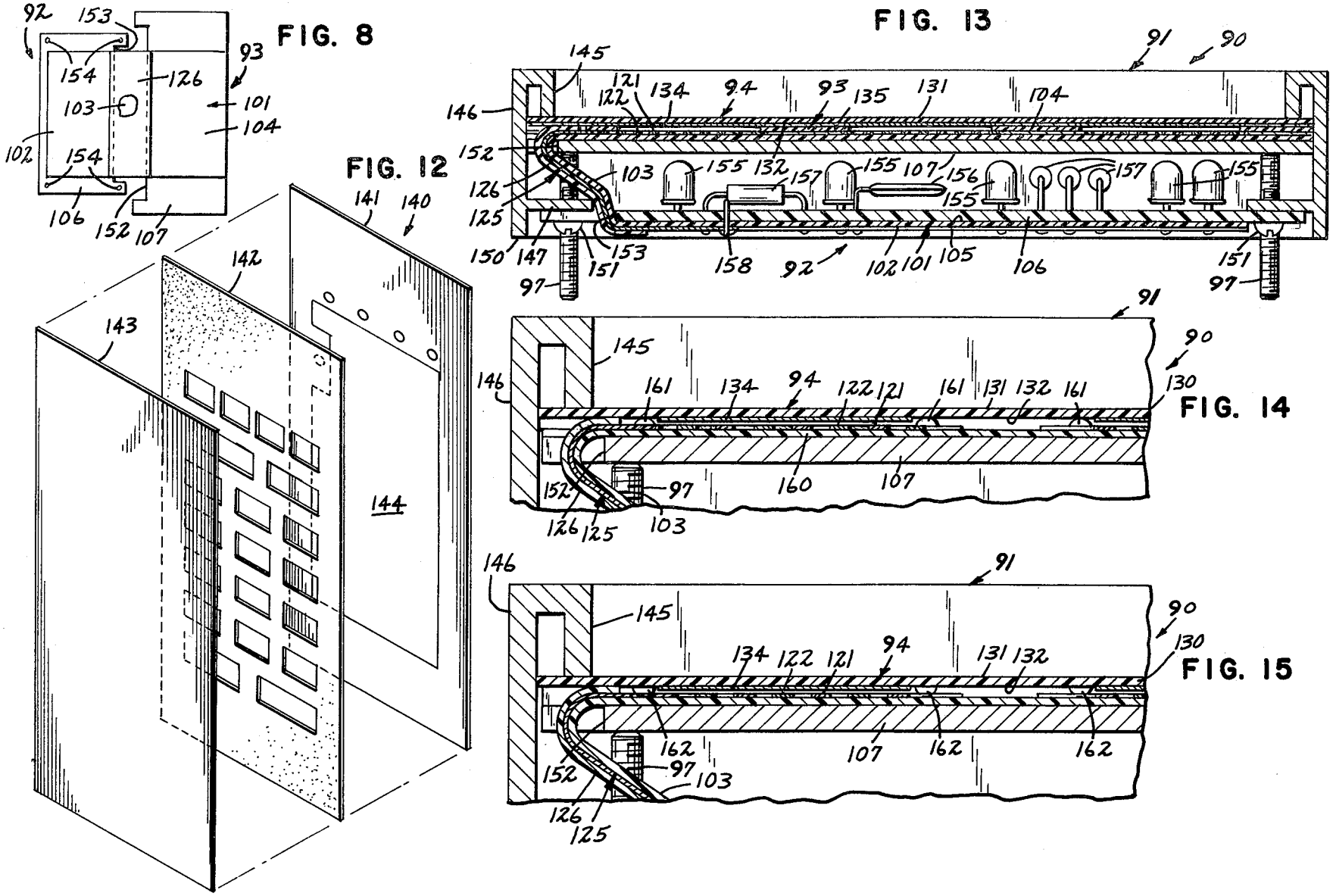
FIG. 8 is a diagramatic plan view of a portion of the invention showing the configuration and relation of some of the parts.
FIG. 12 is an exploded view of a modification of the component shown in FIG. 11.
FIG. 13 shows a transverse section of one embodiment of the invention taken generally along the line 13—13 of FIG. 7.
FIG. 14 is a fragmentary view like FIG. 13 of a second embodiment of the invention.
FIG. 15 is a similar view of a further embodiment of the invention.

FIG. 8 shows that a single sheet of Mylar may be used as a base not only for printed circuitry associated with the keyboard components, but also for printed circuitry associated with the pilot components as well. Such a sheet is shown at 101 to have a left hand portion 102 for association with pilot components 92, a central fold portion 103, and a right hand portion 104 for association with keyboard components 93. One face 105 (See FIG. 10) of sheet 101 is shown as secured at a first end to a mounting strip or board 106: at a second end it is in apposition with a stiffener board or strip 107, to which for some applications it may also be secured adhesively.

As shown in more detail in FIG. 9 and 10, the other face 110 of sheet 101 bears at its first end printed circuitry 111, shown only schematically, appropriate to properly interconnect the discrete operative components, and at its second end printed circuitry 112 appropriate to perform keyboard switching functions as previously described. Thus comb-like elements 113 and 114 may be conductively interconnected to perform a first switching function connecting conductors 115 and 116, elements 113 and 117 may be conductively interconnected to perform a second switching function connecting conductors 115 and 120, elements 121 and 122 may be conductively interconnected to perform a third switching function connecting conductors 123 and 124, and so on.

Appropriate interconnection between circuitry 111 and circuitry 112 is conveniently made by a bank 125 of parallel printed conductors extending across the fold portion 103, which may then be overlaid by a flexible reinforcing member 126, also of electrically insulating material.

A number of small apertures are distributed over the surface of mounting strip 106, and also pass through sheet 101, at points where conductors of circuitry 111 terminate or cross. As is conventional in circuit board construction, the leads of discrete components are positioned or bent to pass through these holes, from the bottom as seen in FIG. 9, so that the components can be connected into the printed circuit by a drop of solder when each conductor has been cut off substantially at the surface of the printed circuit.

The structures of FIGS. 8–10 is intended to be used, as shown in FIG. 13, by being folded at center portion 103, strip 126 being on the outside of the fold, and then being inserted into frame 91 for cooperation of members 113, 114, etc. with suitable conductive areas on cover 24, which will now be described.

FIG. 11 is a back view of cover 94, which is shown to be laminated. Its principal thickness is an insulating sheet or lamina 130, which includes aperture 98 and light-passing areas 96, and which bears on its face 131 the various indicia shown in FIG. 7. On the back 132 of sheet 130, positioned in agreement with the indicia on the face, are electrically conductive areas, preferably in the form of parallel lines of conductive material, although solid deposited areas or foil could also be used. Thus area 133 is directly in line with START label 95, area 134 is in line with the "4" label, and so on.

In this embodiment of the invention no ridge surrounds any of the areas 133, etc. Instead, a second lamina 135 of transparent, electrically non-conductive material, adhesive on both of its surfaces, is secured to lamina 130. Lamina 135 has apertures positioned for alignment with conductive areas 133, etc., and performs the spacing function of the ribs of FIG. 2. A peelable lamina or cover strip 136 overlies lamina 135: if used as a backing during the punching of lamina 135, this cover strip may also have apertures.

In use, lamina 136 is peeled off and discarded, exposing an adhesive-covered surface of lamina 135 by which the cover is secured to portion 104 of sheet 101 so that indicia 125 are properly aligned with electrodes 113, 114, etc.

A cover 140 slightly different from cover 24 is shown in FIG. 12, wherein laminae 141, 142 and 143 correspond generally to laminae 130, 135 and 136 of FIG. 11. Lamina 142 is transparent, perforated, and coated with adhesive on both sides. Lamina 143, peelable from lamina 142, is not apertured in this form of the cover. Lamina 141 has a single conductive area or face 144 instead of the electrically independent members on area 94. This arrangement can be resorted to in applications where no undesirable sneak circuits can be developed if finger pressures are applied simultaneously at different indicia of the cover.

FIG. 13 shows an assembled structure according to the invention. Frame 91 has a lip 145 inturned from its outer side 146, and an inner ledge 147 spaced from its inner side 150 and tapped to receive studs 97 and mounting screws 151. After cover 94 or 140 is secured to portion 104 of sheet 103, the assembly is folded along member 103, stiffener strip 107 is inserted, and the combination is slid into end 99 of frame 21 with cover 94 engaging lip 145. Stiffener strip 107 is as wide, at its ends, as the inside of frame 91, but is cut away as at 152 (See FIG. 8) to allow passage of strips 103, 126, and mounting strip 106 is similarly cut away at 153, and is further provided with mounting holes 154 by which it can be fastened to the outside of ledge 147 using mounting screws 151. The distance between lip 145 and ledge 147 is sufficient to leave adequate space for discrete components such as lamps 155, capacitor 156, resistors 157, and bridging wire 158. When the parts are properly positioned, studs 97 are tightened to press against stiffener strip 107, holding the keyboard components in proper relation, and screws 151 are tightened to hold mounting board 102 in position. If a removable end is provided at 99, this can now be installed. Finally, the entire assembly is mounted on the appliance by passing studs 97 through appropriately located holes in the appliance, and completing the fastening with nuts threaded on the studs. It will be appreciated that this assembly task may be simplified if stiffener board 107 is secured to strip 101 like mounting board 106.

The embodiment of the invention shown in FIG. 14 differs from that of FIG. 13 in that sheet 160, corresponding to sheet 103 of FIG. 13, is formed with ridges 161, as taught in FIG. 1, surrounding the printed switch contacts, so that the function of spacing sheet 135 is accomplished thereby and the sheet is unnecessary.

FIG. 15 shows that if desired ridges 162 may be formed directly on the back of cover 94, obviating the need for a spacing sheet corresponding to sheet 135 of the earlier figure.

Figures 16, 17, 18, 19, 20:
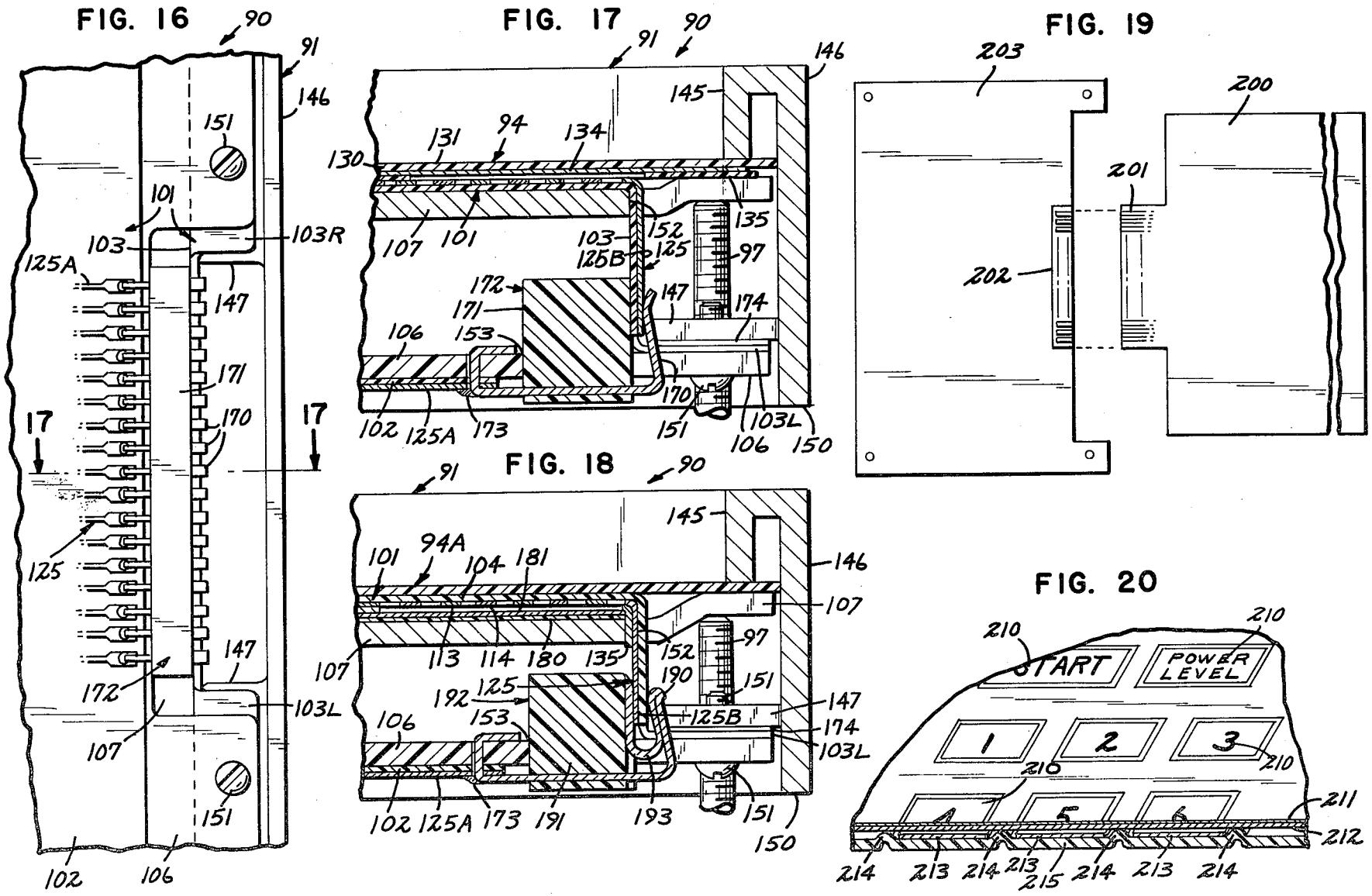
FIG. 16 is a fragmentary rear elevation of an embodiment of the invention.
FIG. 17 is a fragmentary sectional view along the lines 17—17 of FIG. 16.
FIG. 18 is a view like FIG. 17 showing another modification of the invention.
FIG. 19 is a diagramatic plan view, similar to FIG. 8, of another embodiment of the invention.
FIG. 20 is a view in vertical section and perspective of a still further embodiment of the invention.

A part of good design for any piece of equipment is provision for subsequent service and repair. The structure thus far disclosed offers some imperfections in this respect. Service is most likely to be needed for the discrete components on board 106, and as shown in FIG. 13, these components are located where they are out of danger of unintended physical damage, but nevertheless where testing and replacement are not convenient. FIGS. 16 and 17 illustrate an embodiment of the invention which is improved in this respect. Here member 126 is omitted: the sheet 101 and the conductors 125 are not continuous, but are interrupted. The sheet is divided into two parts at its center 103 as indicated by the broken line 169 in FIG. 9, for easy separation of the operative components from the pilot components, and the conductors 125A from circuitry 111 are connected to individual spring components 170 which are molded into the body 171 of a multiple contact electrical connector 172, as shown at 173 in FIG. 17. The conductors 125B of circuitry 112 slide under the spring contacts to complete the electrical connections, and the portions 103L and 103R on each side of the bank 125 of conductors are secured beneath ledge 147 as by pressure sensitive adhesive 174.

Thus it is only necessary to remove screws 151, after which the operative components on board 106 may be disconnected at connector 172, enabling simple removal of the component as a unit for servicing or replacement. In this embodiment of the invention sheet 101 can be secured adhesively to board 107.

FIG. 18 shows another modification of the invention made possible by the provision of a connector. In this Figure cover 94A comprises only the labeled portion 130 of FIG. 7, members 133, etc. being omitted. Portion 104 of sheet 101 is here installed with members 113–114 turned inward rather than outward, and between these laminae and stiffener board 107 are inserted member 135 and a lamina 180 carrying conductive areas similar to areas 133 of FIG. 11, or a single conductive areas similar to areas 133 of FIG. 11, or a single foil 181, insulated by lamina 180 from strip 107 of the latter is metallic and grounding of the circuitry by switch action is not desired: under proper circumstances insulating lamina 180 may be omitted and sheet 107 may serve the circuit closing function.

In this embodiment of the invention the connectors 125B are toward rather than away from body 191 of connector 192, and the spring fingers 190 are modified as at 193 to make the necessary electrical connections.

FIG. 19 is presented to show an embodimennt of the invention in which a flexible sheet 200 of electrically insulating material, carrying keyboard components as before, has an array 201 of conductors which engage the contacts of a connector 202 mounted directly on a circuit board 203 having discrete components mounted thereon. Here the circuit board is complete in itself, no additional sheet carrying a printed circuit being secured thereto.

FIG. 20 shows that the indicia 210 of interest to a user can be part of a painted layer 211 directly on the surface of a metal lamina 212, which is spaced from keyboard components 213 by ridges 214 in an insulating layer 215.

From the foregoing it will be apparent that I have invented a new and improved structure for use in control panels for household appliances and elsewhere as appropriate, particularly where printed circuitry and circuit board construction make possible the incorporaton of the discrete operative components of the control circuitry into the panel itself, and that I have refined the invention to make service and repair convenient.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. In combination:

a pair of smooth sheets of flexible, resilient, electrically insulating material having first surfaces in apposition, said sheets being of uniform thickness;

a first area of electrically conductive material on said first surface of one of said sheets;

a second area of electrically conductive material on the first surface of the other sheet in apposition with said first area;

means independently making electrical connection with said areas;

and a raised ridge embossed in one of said sheets substantially surrounding one of said areas closely enough to normally prevent contact between said areas in the absence of pressure applied externally to the sheets within the outline of said areas, the height of said ridge being of the same order of magnitude as the thickness of the sheet.

2. A keyboard switch construction comprising, in combination:

a sheet of foldable, resilient, electrically insulating material having a fold line, said sheet being of uniform thickness;

a first area of electrically conductive material on one face of said sheet and on one side of said fold line;

a second area of electrically conductive material on the same face of said sheet on the opposite side of said fold line, so that when said sheet is folded on said line, said areas are in apposition;

means independently making permanent electrical connection with said areas;

and a raised ridge embossed in said sheet substantially surrounding one of said areas closely enough to normally prevent contact between said areas in the absence of pressure applied externally to said sheet within the outline of said areas, the height of said ridge being of the same order of magnitude as the thickness of said sheet.

3. A keyboard switch construction, comprising, in combination:

a smooth sheet of foldable, resilient, electrically insulating material of uniform thickness having a fold line;

a first area of electrically conductive material on one face of said sheet and on one side of said fold line;

an elongated conductor on the same face of said sheet on the opposite side of said fold line, so that when said sheet is folded said area and said conductor are in apposition;

and at least one elongated raised ridge embossed in said sheet and along and adjacent to said conductor and close enough thereto to normally prevent electrical contact thereof with said area, the height of said ridge being of the same order of magnitude as the thickness of said sheet.

4. In combination:

a pair of sheets of flexible, resilient, electrically insulating material of uniform thickness having first surfaces in apposition;

electrically conductive means carried by at least one area of said first surface of one of said sheets;

further electrically conducting means carried by at least one area of the first surface of the other sheet in apposition to the first named electrically conducting means;

independent conductor means making permanent electrical connection to the electrically conductive means of at least one area so that when said areas are brought into engagement an electrical circuit is completed between said conductive means;

and a raised ridge embossed in at least one of said sheets adjacent at least one of said areas and close enough thereto to normally prevent engagement between said areas in the absence of pressure applied externally to the sheets within the outline of said areas, the height of said ridge being of the same order of magnitude as the thickness of the sheet.

5. The method of preventing unintended contact between electrically conductive areas on apposed surfaces of resilient non-conductive sheet material of uniform thickness which comprises bordering one of the areas with a ridge embossed in the material to substantially and closely surround the conductive area thereon, the height of said ridge being of the same order of magnitude as the thickness of said sheet.

6. A composite structure comprising, in combination:

a first, flexible sheet of insulating material of uniform thickness;

a second, smaller, rigid sheet of insulating material having one face secured to a first portion of one face of said first sheet;

a plurality of discrete electrical components mounted by their conductors on the other face of said second sheet with the conductors passing through apertures in both said sheets;

a printed circuit on the other face of said first sheet interconnecting said components and extending beyond said second sheet to form the fixed contacts of a bank of normally open switches;

a stiffener sheet smaller than said first sheet and secured to a second portion of said one face of said first sheet opposite said fixed contacts;

means mounting said sheets with said second sheet parallel to and spaced from said stiffener sheet, said components being contained between said second sheet and said stiffener sheet, and said first sheet being folded so that said fixed contacts are on the outside of the space containing said components;

flexible electrically conductive means mounted in alignment with said contacts of said bank of switches for actuation into engagement therewith selectively to close said switches;

means normally preventing engagement between said fixed contacts and said flexible conductive means;

and means for applying localized pressure to said flexible electrically-conductive means to enforce engagement thereof with selected fixed contacts of said bank of switches.

7. A composite structure comprising, in combination:

a rigid mounting sheet of insulating material;

a stiffener sheet;

means mounting said sheets in aligned spaced relationship with inner faces thereof in apposition;

a folded sheet of flexible insulating material having an inner face secured to the outer faces of said mounting sheet and said stiffener sheet;

a plurality of discrete electrical components mounted by their conductors on the inner face of said mounting sheet with the conductors passing through apertures in said mounting sheet and said folded sheet;

a printed circuit on the outer face of said folded sheet interconnecting said components and extending beyond said mounting sheet to comprise the fixed contacts of a bank of normally open switches supported by said stiffener sheet;

flexible electrically conductive means aligned with said contacts of said bank of switches for actuation into engagement therewith to close said switches;

means normally preventing engagement between said fixed contacts and said flexible conductive means;

and means for applying localized pressure to said flexible electrically-conductive means to enforce engagement thereof with selected fixed contacts of said bank of switches.

8. A structure according to claim 7 in which said folded sheet is discontinuous at the fold and a multiple-contact electrical connector enables separation and reconnection between the portions thereof at said discontinuity.

9. A control structure comprising, in combination:

a rigid mounting sheet of insulating material;

a stiffener sheet;

means mounting said sheets in aligned spaced relationship with inner faces thereof in apposition;

a folded sheet of flexible insulating material having an inner face apposed to the outer faces of said mounting sheet and said stiffener sheet, and secured to the outer face of said mounting sheet;

a plurality of discrete electrical components mounted by their conductors on the inner face of said mounting sheet with the conductors passing through apertures in said mounting sheet and said folded sheet a first printed circuit, on the outer face of said folded sheet in apposition with said mounting sheet, interconnecting said components;

a second printed circuit, on said folded sheet in apposition with said stiffening sheet, interconnected with said first printed circuit and comprising the fixed contacts of a bank of normally open switches;

flexible electrically conductive means between said stiffener sheet and said second printed circuit and aligned with said contacts of said bank of switches for engagement therewith to close said switches;

means normally preventing engagement between said fixed contacts and said flexible conductive means;

and means for applying localized pressure to said folded sheet against said stiffener sheet to enable engagement of selected switch contacts with said flexible conductive means so as to close selected switches.

10. A structure according to claim 9 in which said first and second printed circuits are on opposite faces of said folded sheet.

11. In combination:

a first smooth sheet of flexible, resilient, electrically insulating material of uniform thickness;

a contact area of electrically conductive material at a predetermined location on said first sheet;

a raised ridge embossed in said insulating material substantially surrounding and close to said contact area, the height of said ridge being of the same order of magnitude as the thickness of the sheet;

a second sheet of flexible, resilient, electrically conductive material, mounted in engagement with said ridge of said first sheet to be prevented thereby from physical engagement with said contact area in the absence of enabling force applied in a direction normal to said sheets at the location of said contact area;

and support means preventing overall movement of both said sheets in said direction upon application of said enabling force.

12. A composite structure comprising, an electrical connector having plural contacts in spaced side by side relationship;

a circuit board having a plurality of discrete electrical components mounted thereon including said connector, and having a first printed circuit interconnecting said components;

a sheet of insulating material having a second printed circuit comprising the fixed contacts of at least one normally open switch and conductors leading therefrom to the edge of said sheet in the same spaced relation as that of contacts of said connector, so that when said sheet is inserted into said connector circuits are completed from said switch contacts to said first printed circuit, said sheet being flexible to enable it to fold over said circuit board in spaced relation therefrom;

a ridge of insulating material substantially surrounding said fixed contacts of each said switch;

a support board between said circuit board and the folded sheet;

and means mounting an electrically conducting surface in line with said fixed contacts and spaced therefrom by said ridge, so that an electrical circuit is completed thereby in response to pressure applied therethrough against said support board.

13. A printed circuit switch comprising, in combination:

a smooth sheet of electrically insulating material of uniform thickness;

a pair of fixed switch contacts, in close, mutually spaced relation, carried by said sheet;

laminar electrical conducting means apposed to said contacts;

means for enabling relative movement between said sheet and said conducting means to enable simultaneous engagement of said conducting means with said fixed contacts, for completing a circuit therebetween and thereby performing a switching function;

said fixed contacts having configurations of conjoint area;

and said sheet including an embossed ridge of electricaly insulating material substantially surrounding said conjoint area closely enough to prevent engagement of said contacts by said conducting means in the absence of applied enabling force at said conjoint area, the height of said ridge being of the same order of magnitude as the thickness of said sheet.

14. A printed circuit switch comprising, in combination:

a smooth sheet of electrically insulating material of uniform thickness;

pairs of fixed switch contacts carried by said sheet, the contacts of each pair being in close, mutually spaced relation;

laminar electrical conducting means apposed to said contacts;

means for enabling relative movement between said sheet and said conducting means to enable simultaneous engagement of said conducting means with the fixed contacts of any of said pairs, for completing a circuit therebetween, and thereby performing a switching function;

the fixed contacts of each pair having comb-like configurations of known conjoint area, and said sheet including embossed ridges of electrically insulating material substantially surrounding said conjoint areas closely enough to prevent engagement of said contacts by said conducting means in the absence of applied enabling force at one of said conjoint areas, the height of said ridge being of the same order of magnitude as the thickness of said sheet.

15. An article of manufacture comprising, in combination:

a sheet of rigid, electrically insulating material having a field of spaced perforations passing therethrough;

a smooth sheet of flexible, resilient, electrically insulating material of uniform thickness, said sheet being larger than the first named sheet, and having a portion perforated in agreement with the perforations in said first named sheet;

means securing a first surface of the first named sheet to a first surface of said portion of the second named sheet with the perforations in alignment;

electrically conductive material carried on the second surface of the second named sheet, to define a plurality of conductive paths extending from the sites of said perforations and a plurality of conductive areas comprising the fixed contacts of a plurality of normally opened switches at a second portion of said second named sheet;

a plurality of discrete electrical components positioned on the second surface of the first named sheet, and having conductors extending through said perforations to terminate at sites in said conductive paths;

means connecting said conductors to said conductive material at said perforations to mount said components on said first named sheet and complete electrical circuits to said components;

further electrical conducting means movably operable to comprise the movable contacts of said switches; and means normally preventing engagement between said fixed and movable contacts, in the absence of force applied therebetween, comprising embossed ridges in said second named sheet substantially surrounding said conductive areas.

* * * * *